US005338102A

United States Patent [19]

Lent et al.

[11] Patent Number: 5,338,102

[45] Date of Patent: Aug. 16, 1994

[54] METHOD OF MINING

[75] Inventors: Kevin C. Lent, Rogers, Minn.; Brad L. Holsapple, Metamora, Ill.

[73] Assignee: Caterpillar Paving Products Inc., Minneapolis, Minn.

[21] Appl. No.: 82,703

[22] Filed: Jun. 28, 1993

[51] Int. Cl.[5] ..... E21C 27/30

[52] U.S. Cl. ..... 299/10; 299/39; 299/86

[58] Field of Search ..... 299/10, 39, 86, 89; 175/427; 404/90

[56] References Cited

U.S. PATENT DOCUMENTS

| | | | |
|---|---|---|---|
| 3,746,101 | 7/1973 | Takata | 172/112 |
| 4,186,968 | 2/1980 | Barton | 299/39 |
| 4,222,446 | 9/1980 | Vasek | 175/427 |
| 4,738,291 | 4/1988 | Isley | 144/34 R |
| 4,783,123 | 11/1988 | Ottestad | 299/94 |
| 4,838,729 | 6/1989 | Chennels | 299/79 X |
| 5,078,219 | 1/1992 | Morrell et al. | 175/427 |

FOREIGN PATENT DOCUMENTS

| | | | |
|---|---|---|---|
| 1370084 | 7/1973 | France | 299/89 |
| 1029841A | 7/1983 | U.S.S.R. . | |

OTHER PUBLICATIONS

Proceedings of International Symposium of Mine Mechanization and Automation, Golden Co., Jun. 10–13, 1991, "The Development and Testing of The Concave Bit", by D. A. Larson et al.

*Primary Examiner*—David J. Bagnell

*Attorney, Agent, or Firm*—Robert A. McFall

[57] ABSTRACT

A method of mining includes striking the surface of friable to brittle, essentially homogeneous mineral materials with a plurality of concave-faced cutting tools rotating about a longitudinal axis disposed substantially parallel with the surface of the mineral material. Segments of the mineral material are cleaved by the cutting tools as the tools strike the surface and then pass along a predetermined path completely through the mineral material.

4 Claims, 3 Drawing Sheets

METHOD OF MINING

TECHNICAL FIELD

This invention relates generally to a method of mining and more particularly to a method of mining mineral materials with rotatable cutting tools.

BACKGROUND ART

Continuous mining machines typically use conical or point attack bits to remove material. These bits, although inexpensive to produce, require high forces for material excavation that dictate the physical size and power requirements of the mining machine. Also, the mineral material mined by impacting the surface with point attack bits is inherently shattered, reducing a significant portion of the mineral into relatively small pieces and powder. For example, coal mined with point attack bits typically contains 4% to 7% fines which require separation, usually by washing, prior to delivery to an end user. In actual field tests, it was found that 20% to 60% of gypsum mined with point attack bits was reduced to particles having a nominal size of less than ¼ inch. The large percentage of fine particles plugged conveyors and, when stockpiled during winter months, froze into a solid mass that could not be handled until it thawed the following spring.

The present invention is directed to overcoming the problems set forth above. It is desirable to have a method of mining mineral materials that require lower penetration forces and energy requirements than currently used mining methods. It is also desirable to have a method of mining mineral materials that produces well defined, controllably sized, discrete pieces of the mineral material without significant loss of material in the form of dust, powder or fine particles.

DISCLOSURE OF THE INVENTION

In accordance with one aspect of the present invention, a method of mining a mineral material includes rotating a plurality of cutting tools having a concave facial surface about a longitudinal axis that is positioned generally parallel with a surface of the material being cut. The material surface is sequentially impacted, or struck, by the concave cutting tools which penetrate the surface and move along a predetermined path to a preselected depth below the surface and then return to the surface. During movement of the concave cutting tools through the material, segments of the material are cleaved. After cleaving, the segments, a portion of which characteristically have at least one generally curvilinear surface, are removed.

BEST MODE FOR CARRYING OUT THE INVENTION

Figure 1:
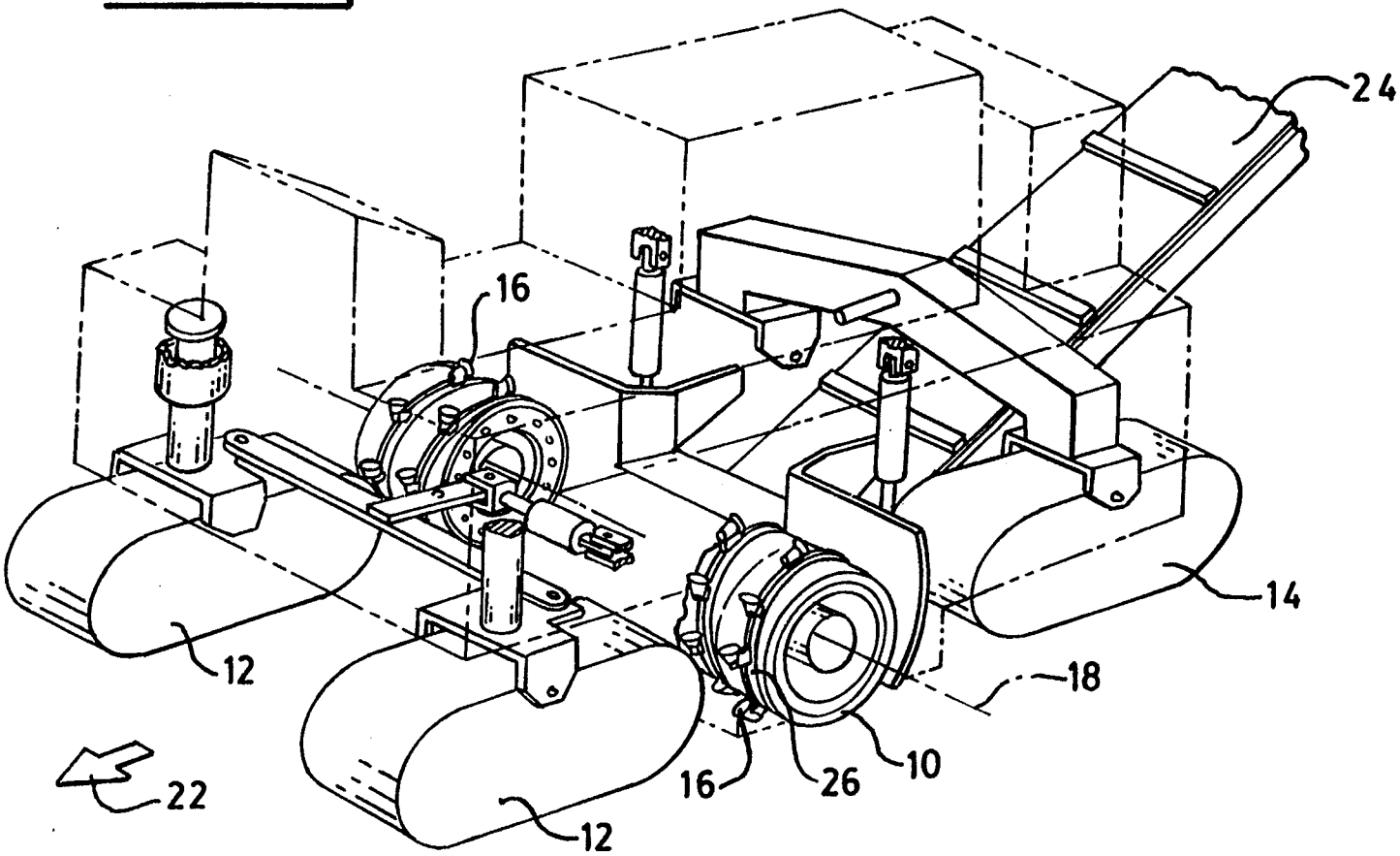
FIG. 1 is a diagrammatic perspective view, largely in block diagram form, illustrating a mining machine arranged for carrying out the method of mining embodying the present invention.

A percussive mining machine for carrying the method of mining embodying the present invention is shown diagrammatically in FIG. 1. The term "percussive mining machine" as used herein means a machine that operates by successively striking or forcibly impacting a material with a cutting tool. Long wall mining machines, roadway milling or planing machines, and road reclaimers are examples of machines that operate by percussing, or impacting, a cutting tool against the surface of a material in the course of making a series of interrupted cuts through the material. Such machines typically have a rotatable shaft or a drum supporting the cutting tools.

In the machine illustrated in FIG. 1, a drum 10 is rotatably mounted between a pair of front ground support members 12 and a pair of rear ground support members 14. A plurality of cutting tools 16, are mounted on the drum 10 in radially fixed, but circumferentially and longitudinally spaced, relationship with a longitudinal axis 18 defined by the rotational axis of the drum 10. The cutting tools 16 are rotated about the longitudinal axis 18, by a drive means operatively connected to the drum, and sequentially and repetitively strike, i.e., impact, a surface 20 of a mineral material 21.

The ground support members 12,14 are vertically adjustable to control the height of the longitudinal axis 18 above, and in a substantially parallel relationship with, the surface 20 of the mineral material. During mining operations, in response to rotation of the cutting tools 10, the tools impact, or strike, and then penetrate the surface 20 to a depth determined by the height of the longitudinal axis 16 above of the surface 20. Simultaneously with rotation of the cutting tools, the mining machine moves forwardly in the direction indicated by the arrow 22. Thus, during cutting operations the longitudinal axis 18 is moved transversely along a path generally parallel with the material surface 20. Usually the longitudinal axis 18 is maintained at a uniform preselected distance above the material surface 20 to provide a consistent depth of cut.

Desirably, a powered conveyor 24 is mounted on the mining machine and is arranged to transport cut segments of mineral material from the drum 10 to a trailing vehicle, such as a haul truck.

Figure 2:
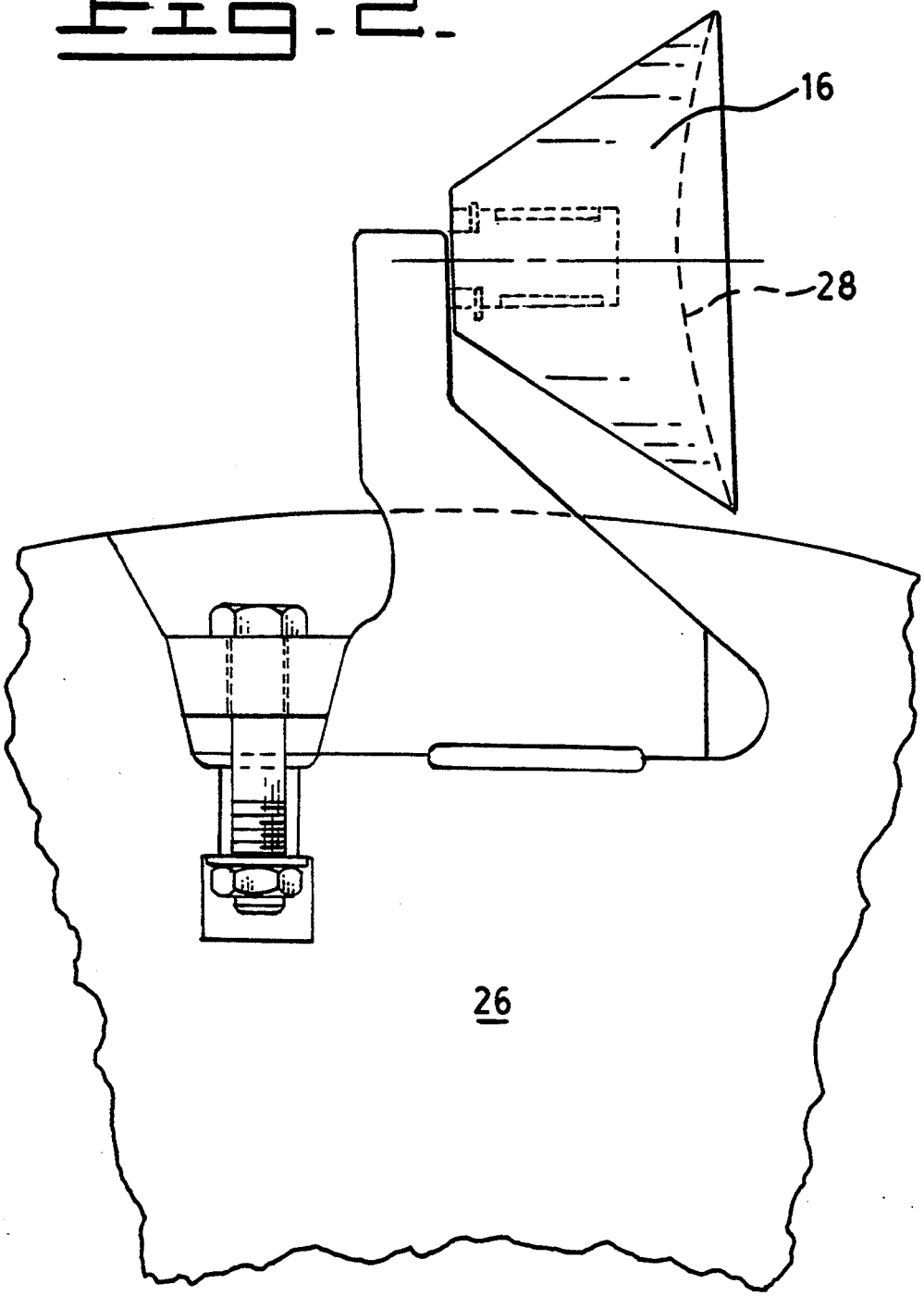
FIG. 2 is a side view illustrating, in elevation, a concave cutting tool for carrying out the method of mining embodying the present invention.

The cutting tools 16, shown in greater detail in FIG. 2, are preferably mounted on flighting 26 attached to the drum 10. Importantly, the cutting tools 16 have a concave facial surface 28 that is essential to carrying out the mining method embodying the present invention. The tools are typically constructed of steel and the face is hardened or has an abrasion resistant coating. Such tools have heretofore been proposed for use by the U.S. Bureau of Mines in non-percussive, continuous cutting applications such as drilling or reaming (U.S. Pat. No. 5,078,219 issued Jan. 7, 1992 to Roger J. Morrel et al). Also, Soviet Union Patent No. 1,029,841 proposes the use of a concave cutter bit for agricultural cultivation.

In carrying out the method of mining embodying the present invention, the concave faced cutting tools 16 sequentially, i.e., one after another in a repetitive series, impact the mineral material surface 20 in response to simultaneously rotating the cutting tools and moving the machine carrying the cutting tools in the forward direction. By controlling the rotational speed of the drum-mounted cutting tools 10 and the forward speed of the machine, the cutting tools are moved along a predetermined path through the mineral material 21.

Figure 3:
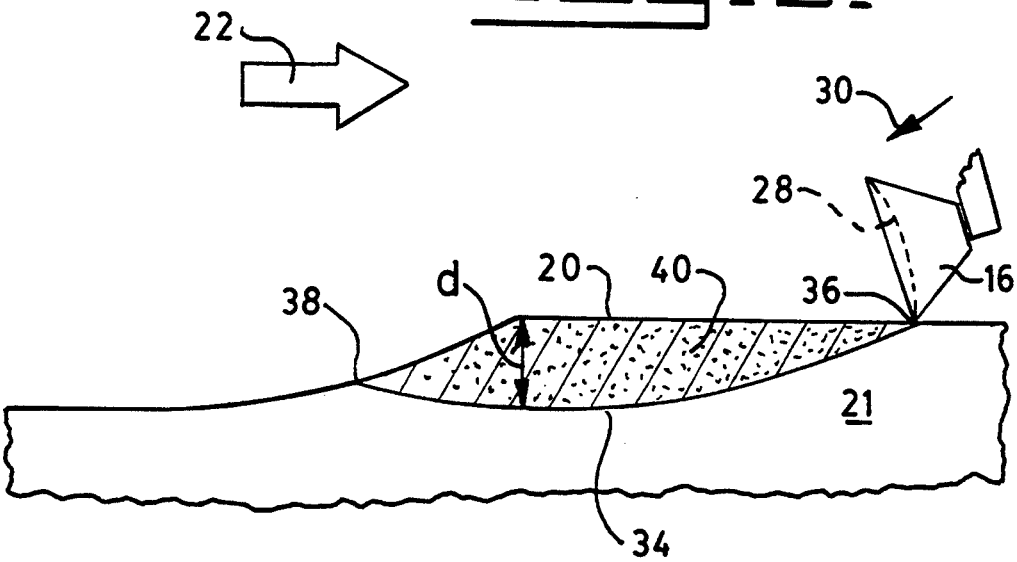
FIG. 3 is a diagrammatic representation showing the area of the material cleaved, and the path traversed, by a concave cutting tool operating in a downcutting mode in carrying out the method of mining embodying the present invention.
Figure 4:
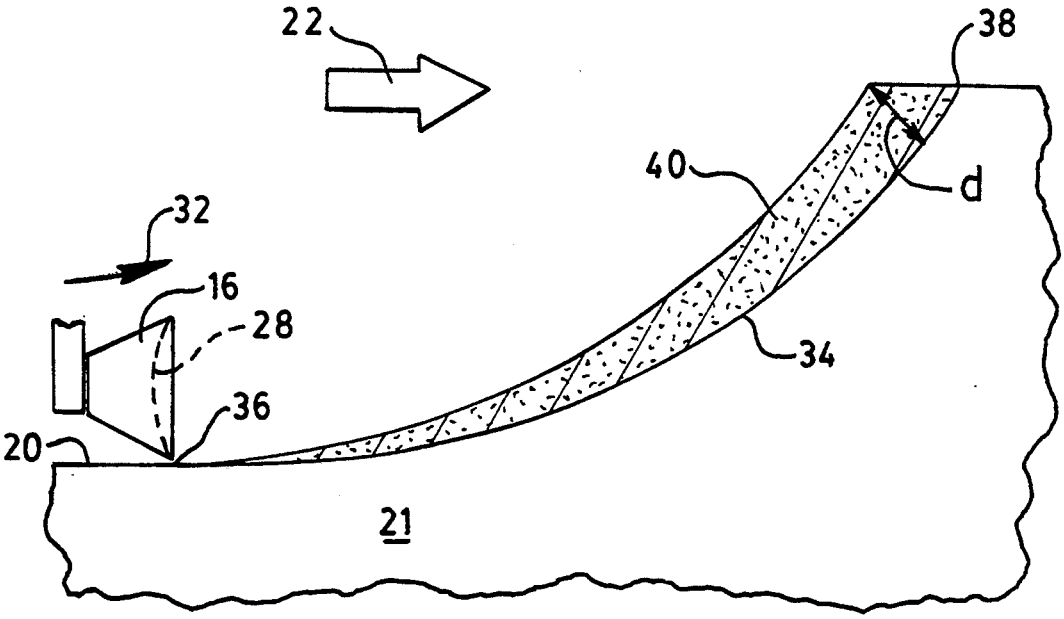
FIG. 4 is a diagrammatic representation showing the area of the material cleaved, and the path traversed, by a concave cutting tool operating in an upcutting mode in carrying out the method of mining embodying the present invention.

As shown in FIG. 3, when arranged in a downcutting mode the cutting tools are rotated in a clockwise direction as indicated by the arrow 30 and the machine is moved in the direction of the arrow 22. In FIG. 4, an upcutting mode is illustrated wherein the cutting tools are rotated in a counter clockwise direction 32. In either mode, the radially outer surface of each of the concave cutting tools 16 traverses a predetermined path 34 that begins at an impact point 36 of the tool with the surface 20, continues to a preselected penetration depth "d" of the tool below the surface 20, and then returns to the surface at an exit point 38.

During movement of the concave cutting tool 16 through the mineral material 21, segments of the material are cleaved from an area 40 defined by the surface 20 and the path 34 of the peripheral edge of the cutting tool 16. The words "cleave" and "cleaved" as used herein mean fragmenting or splitting a mineral material along definite planes by delivering a cutting blow with a tool that passes completely through the material.

Significantly, most mineral materials such as coal, gypsum and potash are found in naturally formed stratified layers. It has been discovered that such materials will split along definite planes when delivered a cutting blow by a concave-faced cutting tool passing through the material, i.e., when cleaved.

Tests were conducted to compare conventional point attack bits with concave-faced cutter bits in percussively applied, interrupted cut, mining of mineral materials. The tests were made in gypsum cement material, having a compressire strength (Qu) of about 9300 psi (6400 N/cm2) and a diametrical tensile strength (Td) of about 370 psi (255 N/cm2). The compressive/tensile strength ratio (Qu/TD) of the gypsum cement was therefore about 25, between that of natural gypsum (typically about 12) and moderately hard coal (typically about 44).

Four tests were run, point attack and concave bits in an upcutting mode, and point attack and concave bits in a downcutting mode. Seven concave cutter bits, each having a face diameter of 2.5 inches (63.5 cm) were circumferentially positioned about a drum at 0.98 inches (25 mm) apart measured across the width of a rotary drum, i.e., along the longitudinal axis of the drum. Twelve standard point attack bits were circumferentially positioned at 0.6 inch (15 mm) apart across the width of a drum. The gypsum cement test block had a width of about 7.68 inches (i95 mm). Thus, both drums effectively cut about the same width of material to the same depth and removed essentially the same amount of material, even though the rotor with concave bits had only seven bits whereas the point attack rotor required twelve bits.

The tests were run with a cutter tip speed of about 1,000 fpm (305 m/min), 40 fpm (12.2 m/min) feed rate of the test sample, mounted on a traveling table, to the rotor, and a 2 inch (50.8 cm) depth of cut. The measured values of horizontal and vertical forces, rotor input torque, tip speed and relative forward velocity between the rotor and test sample were recorded. These values, along with the calculated horsepower requirements for each test are as follows:

GYPSUM CEMENT TEST SUMMARY

| BIT | DIR | HORIZ | VERT | TABLE | TIP | HP |
|---|---|---|---|---|---|---|
| P | UP | 1068 | 839 | 40.5 | 948 | 25 |
| C | UP | 404 | 172 | 40.6 | 970 | 10.6 |
| P | DN | −584 | 1037 | 40.9 | 950 | 24.6 |
| C | DN | −464 | 441 | 40.8 | 947 | 16.1 |

Where:
Under BIT, P = point attack or conical bit
C = concave bit
DIR, UP = upcut mode
DN = downcut mode
HORIZ = measured horizontal force in pounds
VERT = measured vertical force in pounds
TABLE = forward feed rate in fpm
TIP = cutting tool tip speed in fpm
HP = calculated horsepower consumption The above test demonstrates that significantly less energy is required to mine brittle homogeneous minerals by the method of the present invention than with current methods using point attack bits. In particular, 35% to 55% less energy was required to cut the sample gypsum material.

It was also found that the material cleaved by the concave-faced cutter bits operating in the upcut mode had many large pieces that had been broken out, with the breaks propagating toward the top surface and seldom below the cut depth. The surface, after being cut by the bit, had a characteristic smooth trough shape where the bit had traveled. In the downcut mode, the remaining surface of the troughs was not quite as smooth as the upcut troughs, and there were a few places where the pieces being broken out were below the depth of cut. In either mode the segments of material cut by cleaving with concave cutting tools were much larger in size than the material removed by the point attack bits and generally had a characteristic curvilinear shape on at least one surface. The curvilinear surface was either concave or convex, depending if it was above or below the concave bit as the bit passed through the cut. In marked contrast, the point attack bits left jagged surfaces and the cuts were not as "clean" as the concave bit produced surfaces. Also, the material removed by the point attack bits was in much smaller, fragmented pieces, and there was also significant powdering of the material.

After cleaving, the segments are removed from the cut surface. Preferably, the rotor carrying the concave cutting tools includes flighting elements 26 which serve as a screw conveyor to move the material segments along the longitudinal axis 18 to a predetermined position, such as adjacent the conveyor 24. Alternatively the pitch of the flighting 26 may be arranged to transfer the material segments to the center or to an end of the rotor 10 whereat the material may be windrowed and picked up by a loader.

Industrial Applicability

The method of mining embodying the present invention is particularly useful for mining friable to brittle, substantially homogeneous minerals that can be split by cleaving along defined planes. The significant properties determining the suitability of minerals for mining by the present invention are believed to be compressire strength, diametrical tensile strength, and the ratio of compressire to diametrical tensile strength. The measured properties of natural gypsum, the gypsum cement formed for the above discussed comparative test, and the published property values for moderately hard coal are summarized as follows:

| Material Type | Mineral Properties: Compressive Strength (Qu) PSI | Mineral Properties: Diametrical Tensile Strength (Td) PSI |
|---|---|---|
| Gypsum | 4200 | 350 |
| Gypsum Cement (Test Material | 9300 | 370 |
| Moderately Hard Coal | 4400 | 100 |

Based upon the above described test in gypsum cement material, it is believed that the method of mining embodying the present invention is applicable to mining friable to brittle, homogeneous mineral materials having a compressire strength (Qu) of less than about 12,000 psi (8274 N/cm$^2$) and a diametrical tensile strength (Td) of less than 1200 psi (827 N/cm$^2$).

Laboratory and preliminary field tests indicate that a productivity increase, measured in tons of material mined per machine hour, of 60% to 135% can be achieved in mining gypsum by the method embodying the present invention over present methods. It is believed that similar, or better, productivity increases will be realized in mining other minerals, such as coal, by the present invention.

Furthermore, because of the lower energy required to mine minerals by the present invention, the wear and service life of mining machines will be increased. Also, it should be noted that fewer cutting tools, i.e., bits, are required to mine equivalent amounts of mineral than with the presently used conventional point attack bits. All of these advantages, result in significantly lower operating and production costs, and are significant benefits directly attributable to the present invention.

Other aspects, objects and advantages of this invention can be obtained from a study of the drawings, the disclosure, and the appended claims.

What we claims is:

1. A method of mining a mineral material, comprising:

rotating a plurality of cutting tools having a concave facial surface about a longitudinal axis, said axis being disposed substantially parallel with a surface of said material;

sequentially impacting said surface of the material with said cutting tools;

moving said cutting tools along a predetermined path through said material, said path beginning at said surface of said material and continuing to a preselected depth below said surface and returning to said surface;

cleaving segments of said material during the moving of said cutting tool through the material, a portion of said segments having at least one generally curvilinear surface; and removing said segments.

2. The method of mining a mineral material, as set forth in claim 1, wherein said longitudinal axis is moved transversely along a path generally parallel to said material surface simultaneously with rotating said cutting tools about said longitudinal axis.

3. The method of mining a mineral material, as set forth in claim 2, wherein said longitudinal axis is maintained at a preselected distance from the surface of said material during movement along said path.

4. The method of mining a mineral material, as set forth in claim 1, wherein subsequent to removing said segments of the material, said segments are moved along said longitudinal axis to a predetermined position.

* * * * *